United States Patent [19]

Yan

[11] Patent Number: 5,024,752

[45] Date of Patent: Jun. 18, 1991

[54] UPGRADING OF RESIDS BY LIQUID PHASE MILD COKING

[75] Inventor: Tsoung Y. Yan, Philadelphia, Pa.

[73] Assignee: Mobil Oil Corporation, Fairfax, Va.

[21] Appl. No.: 408,353

[22] Filed: Sep. 18, 1989

Related U.S. Application Data

[63] Continuation-in-part of Ser. No. 105,987, Oct. 6, 1987, abandoned, which is a continuation of Ser. No. 854,952, Apr. 23, 1986, abandoned.

[51] Int. Cl.[5] ..... C10G 9/14

[52] U.S. Cl. ..... 208/131; 208/308; 208/309; 208/39; 208/46

[58] Field of Search ..... 208/108, 131, 308, 309, 208/39, 40

[56] References Cited

U.S. PATENT DOCUMENTS

| | | | |
|---|---|---|---|
| 1,933,507 | 10/1933 | Peck | 208/131 |
| 1,934,049 | 11/1933 | Edson | 208/131 |
| 1,998,248 | 4/1935 | Loomis | 208/131 |
| 2,656,307 | 10/1953 | Findlay | 208/50 X |
| 2,752,290 | 6/1956 | Beattie | 196/50 |
| 4,049,538 | 9/1977 | Hayashi et al. | 208/50 |
| 4,149,971 | 4/1979 | Deuser et al. | 210/71 |
| 4,177,133 | 12/1979 | Hayashi et al. | 208/50 |
| 4,414,105 | 11/1983 | Billon et al. | 208/309 |

*Primary Examiner*—Helane E. Myers

*Attorney, Agent, or Firm*—Alexander J. McKillop; Charles J. Speciale; Robert B. Furr, Jr.

[57] ABSTRACT

Heavy resid oils are upgraded by a thermal treatment under liquid coking conditions to evolve two at least partially immiscible liquid phases. The lighter gas oil phase is then separated from the heavier liquid coke phase by decantation.

7 Claims, 2 Drawing Sheets

UPGRADING OF RESIDS BY LIQUID PHASE MILD COKING

CROSS-REFERENCE TO RELATED APPLICATIONS

This is a continuation-in-part of application Ser. No. 105,987, filed Oct. 6, 1987, now abandoned, which is a continuation of application Ser. No. 854,952, filed Apr. 23, 1986, now abandoned.

BACKGROUND OF THE INVENTION

This invention relates to the upgrading of hydrocarbon residues to obtain valuable products therefrom. More specifically, the invention relates to a thermal process for upgrading petroleum residua.

It is important to find improved methods of processing petroleum residua because the quantity of high quality petroleum stock is dwindling. More of the higher value petroleum products must be obtained from the whole crude and in particular from the resid. It is essential to remove metal, nitrogen, sulfur and other contaminants from the petroleum residua since such contaminants greatly reduce the value of the coke produced or poison the catalysts used in various upgrading processes.

Various methods are used to upgrade heavy petroleum residua to products of higher value and saleability. These methods have included hydrogenative processing in which the residua is contacted with hydrogen in the presence of a hydrogenation catalyst to remove the metals, nitrogen, and sulfur compounds contained in the residua, and hydrotreating to saturate aromatic and asphaltene compounds contained therein. Another commonly used method of upgrading residua is solvent extraction such as deasphalting. In this process the residua is contacted with a solvent such as propane to precipitate the high molecular weight asphaltene fraction.

Another common technique for upgrading residua is thermal processing, for example, coking. In this thermal process the heavy hydrocarbon feed is heated rapidly to cracking temperatures so as to convert the feed into cracked vapors and solid coke which is produced at typical coking conditions in amounts of greater than about 20 wt. % based of feed. Another thermal process is thermal visbreaking, a relatively mild cracking process in which the higher molecular weight components in the resid are cracked to lighter products.

Visbreaking promotes condensation reactions which yield carbonaceous materials including toluene insolubles which are incompatible with the remaining products and are undesirable. Under visbreaking conditions, these toluene-insoluble compounds remain in a liquid phase. These toluene-insoluble compounds are physically indistinct at the macro level from the remainder of a visbreaker product stream. Thus, the visbreaker product forms a single stable liquid phase which cannot be separated by decantation. The insolubles are even less desirable than solid coke in that they have little or no commercial use. Visbreaking conditions, therefor, are generally controlled to limit the formation of toluene insolubles to less than 0.5 wt. % based on feed.

The term "toluene-insolubles" as used herein is not the equivalent of "solid coke". The toluene-insolubles fraction is a complex hydrocarbon mixture soluble in solvents such as pyridine and tetrahydrofuran, and nominally has a hydrogen content of about 6–7 weight percent. Pyrolysis of a toluene-insolubles fraction yields a solid coke residue which represents substantially less (up to 30 to 50 percent less) than the original toluene-insolubles weight.

Hydroprocessing techniques such as those discussed above employed to upgrade resid require high hydrogen pressures, low flow rates and high temperatures. High capital investment and operation costs are thus necessitated. Solvent extraction using light hydrocarbons as solvents generally lacks selectivity for the contaminants and thus high ratios of solvent to residua requirements are required. The requirement for large amounts of solvent increases the capital investment cost as well as operational costs and energy consumption. The poor selectivity of the solvent extraction process leads to the production of a large volume of low value asphaltene. Disposal of this asphaltene can itself become a problem.

Coking to upgrade the petroleum residua is becoming more and more popular in the petroleum industry due to the need for minimizing residual fuel production. However, coking is both capital and operation cost intensive. Handling of solid coke including drilling, blowing-down and transportation is expensive. A substantial amount of solid coke, 20 to 40% by weight of resid, depending on the nature of the resid, is produced in the process. Coke yields generally range between 100 and 200% of the resid's ASTM D-189 Conradson Carbon Residue.

Due to the high levels of metal and sulfur contamination, the solid coke from low quality resids is often sold as fuel coke at about $20 per ton. Furthermore, a low quality resid often yields shot coke. Shot coke is currently valued at less than $10 per ton. To put these prices in perspective, it is interesting to note that the prices of crude and resids are $200 per ton and $150 per ton, respectively.

There are numerous patents related to the coking of heavy petroleum feeds including petroleum residua. Typical patents include U.S. Pat. No. 3,247,095 and 4,394,250. The latter patent also discloses adding small amounts of cracking catalyst and hydrogen to the hydrocarbon feedstock before it is charged to the coking drum. In U.S. Pat. No. 4,522,703 solid carbonaceous fines are incorporated into the feedstock which is subsequently converted to gasoline, gas oil, and resid tar. U.S. Pat. No. 4,522,703 is incorporated herein by reference.

Accordingly, it is an objective of the present invention to provide a less expensive process as an alternative to the conventional methods for upgrading resids. A further objective is to maximize the yield of upgraded liquid product without the use of external hydrogen. Another objective is to minimize the yield of solid coke and gas in the coking process. Still another object is to provide a continuous process thereby eliminating the need for a batch or semi-batch process. Other objectives of the present invention will become apparent from the accompanying description and illustrated Example.

SUMMARY OF THE INVENTION

It has been found that under closely controlled thermal treatment conditions, a residuum feedstock can be converted to a product stream comprising two distinct liquid phases. These liquid phases can then be continuously decanted and withdrawn as two separate streams. The denser of these two phases comprises toluene insoluble compounds as mentioned above. This phase is referred to hereinafter as "liquid coke". Liquid coke can be solidified at low temperatures but is distinguished from "solid coke". The term "solid coke" as used herein refers to the solid product of a coking process. Solid coke is extremely deficient in hydrogen and cannot be liquified under petroleum refining process conditions.

The present inventive process converts a feedstream comprising a petroleum residuum under process conditions more severe than visbreaking but less severe than coking. These process conditions are unique to a particular residuum feedstock and fall within temperature and residence time ranges which produce toluene insoluble yields of between 1% by weight and the Conradson Carbon Residual weight percentage. Conversion within these severity ranges yields a two-phase liquid product separable by decantation at elevated temperature.

In accordance with the present invention, petroleum residua is upgraded to products of higher value by a two-stage liquid coking process. In conducting the process of this invention it is critical that the first, or liquid coking, stage be conducted under as severe temperature conditions as possible without causing substantial formation of solid coke. Thus, liquid coke production preferably approaches, but must not exceed, the Conradson Carbon Residue. In the second stage the temperature is lowered to prevent solid coke formation and the residence time is extended to insure complete phase separation. Upon completion of the second stage, the product separates into two liquid phases which are removed from the system continually in separate streams.

The upper phase may be fed to a hydrotreating process or a catalytic cracking process. The relatively low impurity content of the upper phase also makes this an ideal feedstock for a solid coking process to produce premium quality, e.g. metallurgical grade, coke. The upper phase may also be sold as a heavy fuel.

The bottom phase may be used as a heavy fuel or as an asphalt or pitch. The bottom phase may also be charged to a solid coking process to yield additional light products. The solid coke formed by the bottom phase would be enriched in impurities. This coke would be useful as solid fuel in applications where the combustion flue gas purity is not critical and where the coke is not expected to meet metallurgical purity specifications.

DETAILED DESCRIPTION OF THE INVENTION

Figure 1:
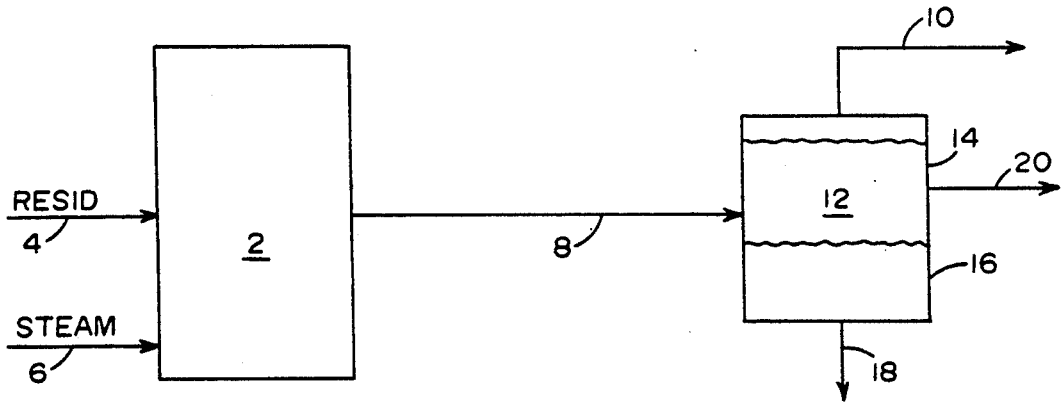
FIG. 1 represents a schematic diagram illustrating one embodiment of a resid upgrading scheme in accordance with the present invention.

In accordance with the present invention, petroleum residua is upgraded to products of higher value by thermal treatment as follows:

(1) a feedstream containing a heavy hydrocarbon residuum is heated so that only additional gas and liquids are formed without substantial formation of solid coke. For a typical residuum stock this is equivalent to a temperature between about 800° and about 1000° F. (427°-538° C.), a pressure between about 100 and about 1000 psi, and a residence time of about 1 to 100 min. The operational range, however, for each specific residue is very narrow. In general, the operating conditions useful to promote the formation of two at least partially immiscible product streams comprise combinations of temperatures and residence times which produce a toluene insoluble phase of between about 1 weight percent and the Conradson Carbon Residual weight percentage of the residuum feedstock, preferably between about 5 weight percent and the Conradson Carbon Residuum weight percentage of the feedstock. The heating preferably is carried out as rapidly as possible. Heating can be effected in a heating coil or similar device. However a thermal reactor can be employed to provide a more controlled reaction residence time and severity.

This thermal reaction takes place in a liquid phase and except for small quantities of gas formed, the products are withdrawn as liquid. This differs from conventional coking where all the products except solid coke are removed as vapor. It is a feature of this invention that the thermal treating be operated at as high a severity as possible while avoiding substantial solid coke formation.

(2) The heated resid is then transferred to a second reactor where it is retained for a period of time sufficient to continue thermal cracking to yield more light products and to enable the liquid to coalesce into two phases. The temperature is kept sufficiently high so that the viscosity of the bottom phase is less than 100 cs. This facilitates phase separation and withdrawal of the separated phase from the reactor. The temperature should be kept low enough so that the reaction will not proceed to the point where excessive solid coking occurs and consequential plugging of the reactor. For typical feeds, the operable temperature is 400° to 800° F. The top or lighter phase is a gas oil which is continuously removed from the system and the bottom phase is heavier liquid containing metals and carbon residue and is withdrawn from the bottom of the reactor as the liquid coke product. The temperature can be lower or substantially the same as the first reactor to obtain additional conversion of resids to more valuable light product. However the fluid velocities in this reactor are low to minimize mixing and to facilitate phase separation.

An important aspect of the present invention is the increase in the yield of gas oil without the formation of solid coke and, correspondingly, the liquid coke product is pumpable at a temperature above about 150° C. depending on the severity of the second stage reactor. Liquid coke is defined to be a true, uniform liquid phase and not a suspension of finely divided solid coke particles.

The term "heavy hydrocarbon residue" is meant to include petroleum oil residue and tar sand bitumen feedstocks in which at least 75 wt.% of the constituents have a boiling point above about 700° F. (370° C.).

The severity of thermal treatment conditions can be expressed in terms of severity (S). Severity is conveniently expressed in terms of "equivalent reaction time in seconds" (ERT), as measured at 800° F. A discussion of the meaning of severity as it is expressed in reaction time in seconds and how it is derived is presented in U.S. Pat. No. 4,522,703 which is incorporated herein by reference.

In FIG. 1 of the accompanying drawings the process of this invention is depicted. Heavy residua feedstock and steam are introduced into heater 2 through lines 4 and 6 respectively. In the heater 2 the feedstock is heated to a temperature of between 800° and 1000° F. and pressure of 100 to 1000 psig. At this temperature the feedstock breaks down into lighter hydrocarbons and approaches but does not reach a point of solid coking when the reaction time is short enough. The flow velocity in the tubular reactor is high, so that any heavy material will not deposit on the wall. The feedstock is then transferred by line 8 to the second stage reactor 12 where the liquid is held at a lower temperature of between 600° F. and 850° F. and pressure of 100 and 1000 psig. Except for a small amount of light gas, substantially all of the reactant is in the liquid phase. The preferred configuration of the reactor would have an L/D ratio of 5 to 1, preferably 5 to 2. The small quantity of gas product in the form of overhead vapor is removed through line 10 and recovered downstream. The liquid portion in the reactor divides into two separate phases, 14 and 16, the upper phase 14 being the light and high quality material which is withdrawn through line 20. The top liquid layer which has been removed is an excellent feedstock for cracking or hydrotreating since it has now been almost completely freed of carbon residue and metals, and their contaminants which formerly rendered its use undesirable. The bottom product is liquid coke which contains the concentration of metals and other undesirable elements and is carried off separately through line 18. It can be used as tar, thermal asphalt, pitch, coke, coker feedstock or as a heavy fuel oil.

It is the special feature of this process that the valuable hydrogen content in residue is effectively utilized in this upgrading process. This is achieved by minimizing dry and light gas formation in the relatively low temperature liquid phase reaction in contrast to conventional coking processes. These gas forming reactions are hydrogen losing reactions. In comparison with typical coking processes the instant process produces ⅔ less gas.

Figure 2:
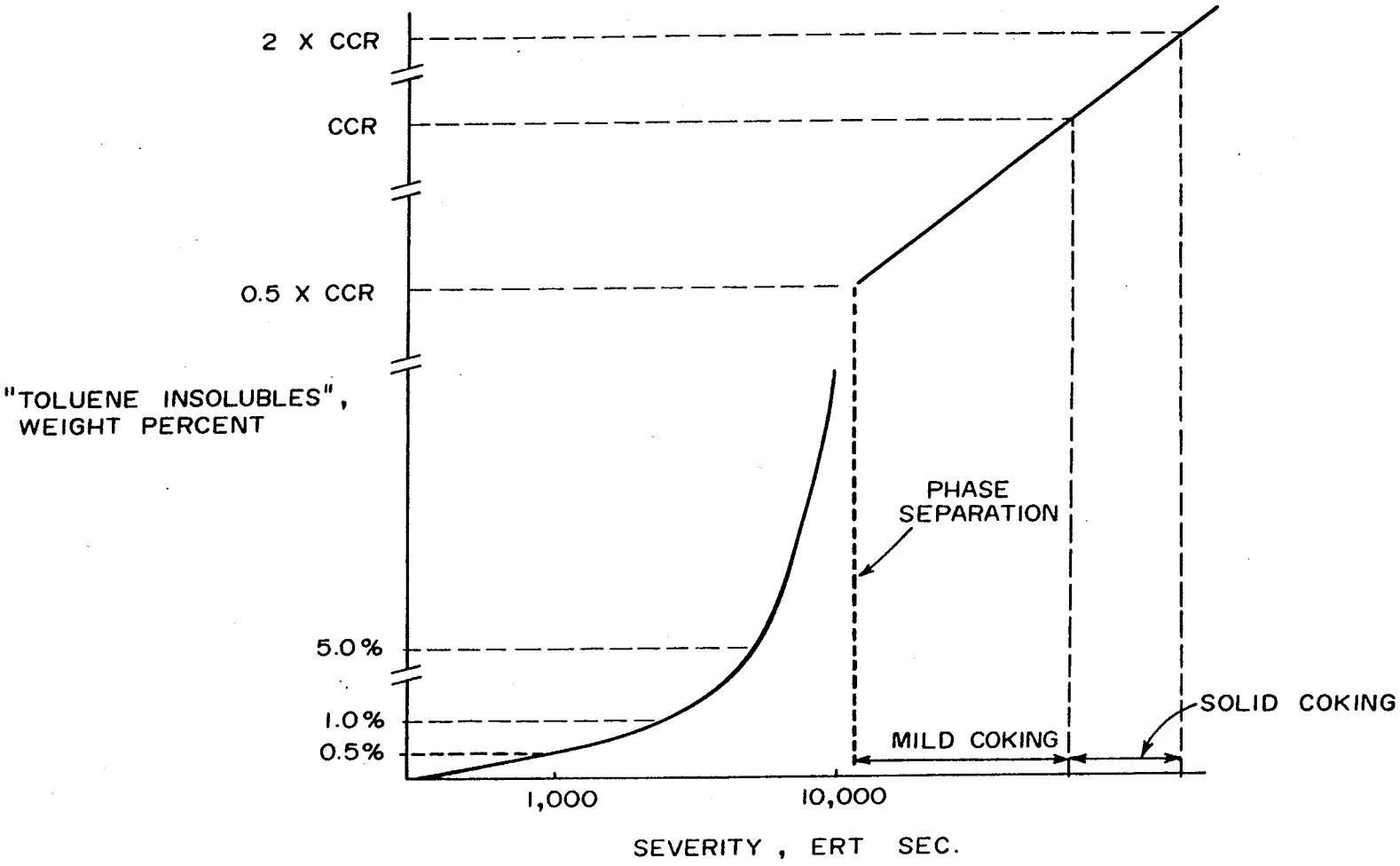
FIG. 2 is a diagram showing the rate of increase of toluene insolubles in a thermally cracked oil with an increase in severity. Thermal treatment of the thermally cracked oil at levels above the dashed vertical line labelled "phase separation" yields solid coke and essentially no liquid coke.

Study has shown that in visbreaking, the toluene insolubles formation increases as the severity increases. The relationship is schematically shown in FIG. 2. The toluene insolubles content in the visbroken product must be kept below 0.5% to assure product stability and compatibility. The visbreaking severity, accordingly, must be limited to below 1,000 sec ERT at 800° F. for typical resids (FIG. 2). As a result, the conversion of resids to valuable light product is limited. The toluene insolubles formation accelerates rapidly, particularly as the ERT exceeds 5,000 sec. At the increased ERT, thermal cracking produces more and more valuable light oil which is relatively immiscible with the toluene insolubles. As a result, when the severity exceeds a critical limit, up to about 10,000, the light oil and toluene insolubles or heavy fraction in the oil become mutually insoluble and phase separation takes place. The upper phase is an excellent light fuel product which is low in viscosity, metal content, and carbon residue. The lower liquid phase is rich in metals, carbon residue and asphaltenes which may be a suitable feed for asphalt production or coking, or as a heavy fuel for the refinery or a power plant. This product is particularly suitable for production of thermal asphalt and pitch.

EXAMPLE

In laboratory tests, the resids were heated at 400 psig in a tubular reactor to 830° F. for a severity of about 2,000 sec ERT. The effluent was directly charged into a second reactor which was maintained at about 600° F. and 400 psig for about 20 minutes. Phase separation took place as discussed above. When one particular coker feed was tested, the following results were obtained for the upper phase product:

Demetalation %: 60
Viscosity reduction, fold: 60
Solid Coke content, %: 0.1
Product yield, wt.%: 85–90

Because of the low solid coke content, this fuel, as produced, could be considered "stable" and compatible with other heavy fuels. This product is an excellent feed for hydrotreating and catalytic cracking. This upgrading technique is more efficient than conventional solvent extraction processes because, through thermal cracking and thermal treatment, a substantial amount of asphaltene is converted to (1) light product which increases the yield of liquid, and (2) residue or liquid coke which facilitates phase separation and deasphalting operations without use of external solvent. In comparison with coking, the process is milder in severity and higher in selectivity for liquid yield and low loss of valuable hydrogen in the form of hydrogen-rich light gases and vapors. As a result the liquid yield of 85–90% is significantly higher than the corresponding conventional coking of about 60%.

It will be seen from the foregoing description that this inventive process offers several advantages over the prior art processes. The product obtained is an upgraded liquid product and is not a product which under prior art processes would have been converted primarily into vapors and a solid residue. The absence of solids in the system promotes the more easy handling of the materials involved as well as the removal of materials therefrom. The process of this invention offers continuous operation rather than the semi-batch of the prior art, because the bottom product from the separator is a pumpable liquid rather than the solid material of the prior art. The yield of gas is much lower in this process which means that much of the feed is preserved from being downgraded to gaseous material, leading to higher yields of good quality liquid product.

Changes and modifications in the specifically described embodiments can be carried out without departing from the scope of the invention which is intended to be limited only by the scope of the appended claims.

What is claimed is:

1. A process for upgrading a heavy hydrocarbon feedstock in the liquid phase to evolve at least one less dense liquid gas oil phase and one more dense liquid coke phase in the absence of substantial solid coke formation, said liquid phases being at least partially immiscible, said process comprising the steps of:

(a) determining the Conradson Carbon Residue weight percentage of said hydrocarbon feedstock;

(b) thermally treating said heavy hydrocarbon feedstock under conversion conditions including a combination of temperature and residence time sufficient to convert at least a portion of said heavy hydrocarbon feedstock, at the highest severity in equivalent reaction time which correlates with liquid coke being formed in a quantity of between about 1 wt. % and 200 wt. % of the heavy hydrocarbon feedstock Conradson Carbon Residue weight percentage in the absence of substantial solid coke formation;

(c) controlling the temperature of said thermally treated heavy hydrocarbon feedstock to prevent substantial formation of solid coke;

(d) holding said liquid of step (c) at said controlled temperature for a period of time sufficient for said liquid to separate into two at least partially immiscible liquid layers;

(e) continuously withdrawing gas oil from the upper layer of said liquid of step (d);

(f) continuously withdrawing liquid coke from the lower layer of said liquid of step (d).

2. The process of claim 1 wherein said conversion conditions include a combination of temperature and residence time sufficient to convert said heavy hydrocarbon feedstock to liquid coke, said liquid coke being formed in a quantity of between about 5 wt. % of the heavy hydrocarbon feedstock and a weight percentage of the heavy hydrocarbon feedstock equal to 200 wt. % of the heavy hydrocarbon feedstock Conradson Carbon Residue weight percentage.

3. A process for converting a heavy hydrocarbon feedstock to at least one less dense gas oil phase and one more dense liquid coke phase comprising the steps of:

(a) establishing a curvilinear relationship defining toluene insolubles yield as a function of reaction severity expressed in terms of equivalent reaction time;

(b) defining a maximum visbreaking severity with reference to said curvilinear relationship as the maximum equivalent reaction time which yields a liquid product which remains in a single phase without substantial phase separation into upper and lower at least partially immiscible phases;

(c) defining a minimum solid coking severity with reference to said curvilinear relationship as the minimum equivalent reaction time which yields a coke product which remains in the solid state at reaction temperature;

(d) thermally treating said heavy hydrocarbon feestock under conversion conditions including an equivalent reaction time greater than said maximum visbreaking severity and less than said minimum solid coking severity to convert at least a portion of said heavy hydrocarbon feedstock to liquid coke in the absence of substantial solid coke formation;

(e) controlling the temperature of said thermally treated heavy hydrocarbon feedstock to prevent substantial formation of solid coke;

(f) holding said cooled liquid of step (e) for a period of time sufficient to decant said cooled liquid into two at least partially immiscible liquid layers;

(g) continuously withdrawing gas oil from the upper layer of said cooled liquid; and (h) continuously withdrawing a uniformly liquid coke phase from the lower layer of said cooled liquid said uniformly liquid coke phase being substantially free of solid coke.

4. The process of claim 3 further comprising determining the Conradson Carbon Residue number as a weight percentage of said hydrocarbon feedstock and controlling the severity of said thermal treatment step at an equivalent reaction time greater than said maximum visbreaking severity and less than an equivalent reaction time sufficient to yield a weight percentage of liquid coke equal to the Conradson Carbon Residue number.

5. A process for converting a heavy hydrocarbon feedstock to at least one less dense gas oil phase and at least one more dense liquid coke phase comprising the steps of:

(a) establishing a curvilinear relationship defining toluene insolubles yield as a function of reaction severity expressed in terms of equivalent reaction time;

(b) defining a maximum visbreaking severity with reference to said curvilinear relationship as the maximum equivalent reaction time which yields a liquid product which remains in a single phase without substantial phase separation into upper and lower at least partially immiscible phases;

(c) defining a maximum solid coking severity with reference to said curvilinear relationship as the minimum equivalent reaction time which yields a coke product which remains in the solid state at reaction temperature;

(d) thermally treating said heavy hydrocarbon feedstock under conversion conditions including an equivalent reaction time greater than said maximum visbreaking severity and less than said minimum solid coking severity to convert at least a portion of said heavy hydrocarbon feedstock into liquid coke which is liquefiable at a temperature of 600° F.;

(e) controlling the temperature of said thermally treated heavy hydrocarbon feedstock to prevent substantial formation of coke which remains in the solid state at at temperature of 600° F.;

(f) holding said cooled liquid of step (e) for a period of time sufficient to decant said cooled liquid into two at least partially immiscible liquid layers;

(g) continuously withdrawing gas oil from an upper layer of said cooled liquid; and (h) continuously withdrawing liquid coke from a lower layer of said cooled liquid.

6. The process of claim 5 further comprising determining the Conradson Carbon Residue number as a weight percentage of said hydrocarbon feedstock and controlling the severity of said thermal treatment step at an equivalent reaction time greater than said maximum visbreaking severity and less than an equivalent reaction time sufficient to yield a weight percentage of liquid coke equal to the Conradson Carbon number.

7. A process for upgrading heavy hydrocarbon oil by thermal treatment which comprises:

(a) heating heavy hydrocarbon oil at temperature of from about 800° to about 1000° F. and pressure of from 100 to about 2000 psi at the highest severity in the range of from about 1 to about 100 minutes as expressed in equivalent reaction time at 800° F., sufficient to convert a portion of the heavy hydrocarbon oil to gasoline and gas oil range hydrocarbons without the formation of coke which remains solid at a temperature of 600° F.;

(b) holding the resulting mixture of heavy and light liquid phases at temperatures of from about 400° to about 800° F. to continue thermal cracking to effect phase separation into two liquid phases with the top phase comprising a gas oil fraction and the bottom phase comprising liquid coke which remains liquid at a temperature of 600° F. said liquid coke being substantially free of material which remains solid at temperatures above 600° F.;

(c) separately recovering the two liquid phases as fractions of gas oil and liquid coke, said liquid coke being substantially free of material which remains solid at temperatures above 600° F.

* * * * *